United States Patent [19]

Moskowitz

[11] 4,230,462

[45] Oct. 28, 1980

[54] METHOD OF IMPROVING TOOL LIFE OF TIC BASE TOOLS

[75] Inventor: David Moskowitz, Southfield, Mich.

[73] Assignee: Ford Motor Company, Dearborn, Mich.

[21] Appl. No.: 967,925

[22] Filed: Dec. 8, 1978

[51] Int. Cl.[3] ..... C04B 35/56; C04B 35/58

[52] U.S. Cl. ..... 51/307; 51/295; 51/309

[58] Field of Search ..... 428/539.9, 472; 51/307, 51/308, 309, 295, 306

[56] References Cited

U.S. PATENT DOCUMENTS

| | | | |
|---|---|---|---|
| 3,580,708 | 5/1971 | Ogawa | 51/307 |
| 3,744,979 | 7/1973 | Kalish | 51/307 |
| 4,046,517 | 9/1977 | Soga | 51/307 |
| 4,063,908 | 12/1977 | Ogawa et al. | 51/307 |
| 4,076,506 | 2/1978 | Valdsaar | 51/307 |
| 4,132,534 | 1/1979 | Valdsaar | 51/307 |

*Primary Examiner*—Donald J. Arnold

*Attorney, Agent, or Firm*—Joseph W. Malleck; Keith L. Zerschling

[57] ABSTRACT

A method of making cemented titanium carbide base cutting tools with increased tool life is disclosed. Substantially unoxidized carbide and binder metal powders are ground to a sub-micron particle size in the presence of a low-boiling oxidation-inhibiting ingredient covering the particles of said powders. A low-boiling pressing aid is added. The ground powders are then subjected to air drying to evaporate said oxidation inhibiting liquid ingredient and the pressing aid consisting preferably of polyethylene glycol. After compacting the waxed ground particles to a predetermined configuration, the compact is first heated to volatize the wax at an appropriate temperature and critically in the presence of a nitrogen based atmosphere which may contain 0–10% $H_2$. The dewaxed compact is then heated to a higher second temperature level for effecting sintering in the presence of a vacuum.

9 Claims, 2 Drawing Figures

METHOD OF IMPROVING TOOL LIFE OF TIC BASE TOOLS

BACKGROUND OF THE INVENTION

In the method of making cemented carbide tools from powdered materials, extremely fine powders are required. The particle size must be sub-micron, as opposed to the micron level typically used in making powdered metal components. This difference in particle size requires a different method for making the powdered product which in turn causes certain attendant problems. In order to refine the starting materials to such a fine particle size range, milling (such as by a ball milling operation) is required for significant periods of time. The smaller the particle becomes the greater the surface area and the greater the susceptibility to oxidation. Oxidized powder ingredients detrimentally affect the consolidation and physical characteristics of the compacted tool product. Accordingly, exposure to air must be minimized during such ball milling so that ingredients such as titanium carbide, tungsten carbide, molybdenum, nickel and cobalt will not oxidize.

It is conventional to employ organic substances which form a protective liquid to check oxidation during milling. Low-boiling liquids are applied because after grinding, these evaporate from the mixture automatically or at a somewhat increased temperature. Low-boiling hydrocarbons may include pentane, hexane, naptha, acetone and benzene, and in some cases chlorinated hydro carbons. Polyethylene glycol may be added as a milling aid, and is typically dissolved in a solvent when added to the mixture.

It is also conventional to press these fine powders into a tool configuration under ambient temperature conditions. To facilitate redistribution of the particles during pressing, to achieve as high a density as possible, a pressing aid, in the form of a lubricant, such as paraffin or polyethylene glycol (such as Carbowax, a commercial product of Union Carbide) is typically employed. Usually, the milled powder is allowed to air dry and Carbowax or paraffin is added as an oxidation-resistant displacement prior to pressing.

The pressing aid and/or milling aid is removed or eliminated from the powder by heating in a protective atmosphere whereby the aids are volatized and carried away in the flowing atmosphere. This latter step is conventionally referred to as the "dewaxing" step and will hereafter be used to mean a step whereby any organic milling or pressing ingredient is eliminated from the powder particles. Such dewaxing step may not necessarily be separate and independent from subsequent sintering operations, because in some instances it may be integrated as the initial heat up stage leading to a sintering temperature level.

A protective atmosphere is necessitated during the dewaxing step to insure that the milled powder remains unoxidized after removal of the protective organic medium. To this end, the art has employed atmosphere controls which have essentially consisted of (a) a 100% hydrogen atmosphere (which in some cases have included some minor dilution with argon or other inert gas), exemplified in U.S. Pat. Nos. 3,490,901; 3,798,009; and 3,762,919, (b) a vacuum essentially devoid of oxygen and nitrogen, exemplified in U.S. Pat. Nos. 3,816,081; 3,756,787; 3,762,919 and 3,964,878. When dewaxing is carried out under a vacuum, the temperature level normally employed is about 400°-600° C.

depending upon the particular milling aid that is to be volatilized. When operating with a hydrogen atmosphere, the temperature level is typically around 400°-800° C. Although there is no known instances of utilizing a hybrid hydrogen atmosphere for purposes of dewaxing, it is known that in connection with the annealing of conventional steels, hydrogen based atmospheres have been employed which may contain small amounts of inert gases such as nitrogen but, usually not exceeding 25%. Such a hybrid atmosphere is typically derived from employing cracked ammonia.

Not until the development of this invention has there been an appreciation that tool life might be related to the type of atmosphere employed during the dewaxing step. Heretofore, any increase in tool life was believed by the prior art to be a result of surface treatments, i.e., the deposition of thin oxide layers resulting from heating to 1600° C. depicted in U.S. Pat. No. 3,615,884, or by the adjustment of the chemistry of the carbide cermet, depicted in U.S. Pat. Nos. 4,019,874 and 3,878,592. The prior art, as represented in these cited patents relating to tool life improvement as well as the group of patents relating to atmosphere control during milling and sintering, fail to appreciate the significance of a non-vacuum or non-hydrogen based atmosphere which facilitates enriching the surface of the carbide particle in such a manner to significantly improve tool life.

SUMMARY OF THE INVENTION

A primary object of this invention is to provide an improved method of making cemented titanium carbide based tool materials having increased tool life, such tool life being increased by as much as 50% for roughing grade titanium carbide tools when compared to the best available commercial titanium carbide cutting tools.

A specific object of this invention is to provide a modification to the mode for dewaxing the powdered materials, for such tools, such modification continuing to facilitate elimination of volatile milling and pressing aids, but to enrich the powder particles in such a manner as to improve the tool life of the cermet fabricated from such powdered materials, such as be sintering in a vacuum at conventional temperatures.

Features pursuant to the above objects comprise: (a) employing method controls that ensure the milling of carbide powders to submicron size without the occurrence of oxidation, (b) deploying a nitrogen based atmosphere (containing 0-10% hydrogen) during the dewaxing step, and (c) sintering such protected and dewaxed carbide particles in an environment substantially devoid of oxidizing gases, typically consisting of a vacuum of less than $10^{-3}$ mm. of Hg.

DETAILED DESCRIPTION

Figure 1:
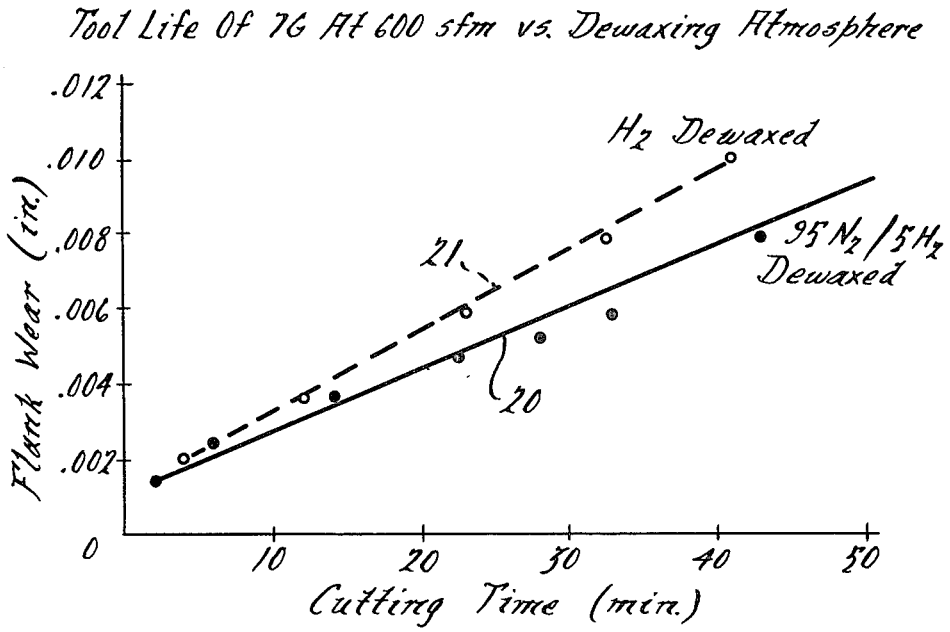
FIG. 1 is a graphical illustration of flank wear versus cutting time for two roughing grade cutting tools, one tool was subjected to dewaxing in accordance with this invention and the other not.

A preferred method for carrying out the present invention comprises:

(1) select and mix unoxidized carbides including titanium carbide and other refractory metal carbide powders and refractory binder metal powders, along with an oxidation retarding or inhibiting ingredient during milling. The solid mixture forms a charge to be treated according to the subsequent steps. The other refractory metal carbides to be employed include the carbides of group 4, 5 and 6 transition metals. Although any of these can be used, the base must be a titanium carbide, from a group 4 transition metal. Mixtures of the foregoing refractory metal carbides can also be used. A chemical analysis for one typical titanium carbide based powder example comprised free carbon 0.1%, combined carbon 19.5%, titanium 79.3% and oxygen 0.19%.

The refractory binder metal powders which can be used are the iron group metals such as nickel or cobalt. An iron group metal that is preferred is nickel to which must be added molybdenum; chromium may also be added. Excellent characteristics for a titanium carbide cutting tool have been obtained by replacing approximately 20% of the TiC with TiN and VC. The amount of refractory metal binders that can be used is operationally in the range of 10–50% of the total solids.

The binder metal powders or alloys are typically added as a 5 micron sized powder. The refractory carbide powder particles typically average about 3.5 microns. The starting particle size distribution using the Turbidimeter method of analysis has shown: 46.4 weight percent was 0–5 microns, 27.3 weight percent was 5–10 microns, and 26.4 weight percent was 10–20 microns.

The oxidation or inhibiting ingredient is added prior to milling typically as a protective liquid that checks oxidation. Low-boiling liquids are applied because, after grinding, these evaporate from the mixture automatically or at a somewhat increased temperature. Low-boiling organic liquids that can be employed include pentane, hexane, benzene, naptha, chlorinated hydrocarbons, and acetone. Acetone has been found to be particularly suitable because it protects the powders from oxidizing during milling, and is easily volatilized without leaving a residue.

(2) The blended mixture is then ground in a suitable milling device, such as a Hastelloy ball mill, the milling being carried out for typically a period of about 96 hours, but from 3–5 days may also be employed. The particle size subsequent to such grinding is typically below one micron, and predominantly 0.5 microns.

(3) The ground mixture is then air dried, permitting the oxidation resistant or inhibiting liquid ingredient to evaporate. At the same time, a small percentage, 1.5–5, of a polyethylene glycol binder or other low boiling pressing aid is added to the ground mixture, typically about 4%. The pressing aid facilitates cold compacting of the powders. Other pressing aids may include: paraffin and stearic acid, all of which act as pressing lubricants, and impart greater strength to the compact. Carbowax 600 is preferred and consists of polyethylene glycol of average molecular weight 600. The pressing aid should be selected on the basis of its volatilization temperature in the range of 400°–700° C. and lubrication qualities.

(4) The dried and waxed ground mixture is then pressed into a desired shape; it is compacted under ambient temperature conditions and under a pressure of about 10 tsi, or more typically in the range of 8–12 tsi, to define a cutting tool shape having some degree of porosity according to configurations found suitable in the art.

(5) The compacted tool is then subjected to a presintering operation or first heating whereby the mass is heated to a temperature preferably in the range of 570°–770° C. for a period of about 0.75–1.5 hours to dewax or remove the pressing aid by volatilization. It is critical that this first heating be carried out under a flowing nitrogen based atmosphere which may contain 0–10% hydrogen. Nitrogen, in the molecular state, is entirely passive to iron or steel and most refractory metals. Although compacts so treated and then subsequently sintered have been found to increase the tool life by as much as 50%, the reason for this improvement is not fully understood. However, it is believed that certain carbonitrides are formed and that the outer surface of the carbide powder particles become enriched with nitrogen in some manner to improve tool life. This theory must be qualified in that applicants have attempted to formulate a cutting tool with a higher proportion of carbonitrides introduced therein; testing of such tools has demonstrated that the greater presence of the carbonitrides did not necessarily correlate with an increase in tool life. The test results from following the present invention indicate a consistent increase in tool life by following the inventive steps herein.

Although the invention is premised upon utilizing starting materials which are substantially unoxidized, it is almost impossible to obtain an absolute unoxidized condition of such fine sized particles; therefore, it has been found convenient to add a small amount of a reducing gas to the nitrogen based atmosphere, which preferably includes about 5 to 10% hydrogen. The small amount of hydrogen serves to reduce any small amount of oxides that may have been formed during the grinding operation (which may include any of the oxides of molybdenum or nickel).

(6) The presintered compact is then subjected to heating on an inert stool in a vacuum within an induction furnace to effect sintering. Heating is carried out preferably for about one hour at temperature level of about 1400° C., the pressure in the furnace being in the range of 0.1–1.0 microns absolute pressure. The sintering temperature is a function of time. The use of a vacuum is essential to prevent the trapping of gases during the sintering step, there being a significant amount of porosity within the compacted object. Trapping herein means the absorption of trace elements of gases that are available in the furnace atmosphere, or adsorbed to the grains of the compact. The gases are trapped by the liquid when it consolidates at temperatures in excess of 1200° C. It is preferable to carry out the sintering step in a two-stage furnace whereby the first stage can be used to carry out the heating for dewaxing and the second stage for sintering without movement of the compact.

FIG. 1 illustrates the tool life improvement that can be obtained for a roughing grade titanium carbide tool which is comprised of 22.5% nickel, and 10% molybdenum for serving as the binder for the titanium carbide. One tool was prepared according to the preferred method of this invention which comprises mixing 22.5% nickel, 10% molybdenum and the remainder titanium carbide, along with sufficient acetone to cover the powders in a ball mill. The mixture was subjected to ball milling for a period of 96 hours rendering a particle size that was sub-micron. Four percent (4%) Carbowax binder was added to the ground mixture, which was then aid dried. The waxed mixture was then compacted at 10 tsi and subjected to a dewaxing heat treatment under an atmosphere consisting of 95% nitrogen and 5% hydrogen. The other tool was similarly prepared except that a pure hydrogen atmosphere was employed during dewaxing. Each of the resulting tools were used in a machining operation; the 95 $N_2/5H_2$ dewaxed tool (plot 20) showed a tool life improvement of 40%.

Tool life is that period of time during which the tool is used in continuous cutting until it has 0.010 "inches of flank wear while being cut at a surface speed of 600 SFM, at a depth of cut of 0.060 inches, and with a 0.011 inch per revolution feed. The material machined was 1045 steel having a Brinell Hardness of 180. The plots of flank wear versus cutting time for the two tools, one (plot 20) subjected to the use of the invention method and the other (21) subjected to the prior art atmosphere, showed that the prior art method experienced at tool life of only 21 minutes, whereas under the same conditions (except for a difference of atmosphere), the tool life was increased to 30 minutes.

Figure 2:
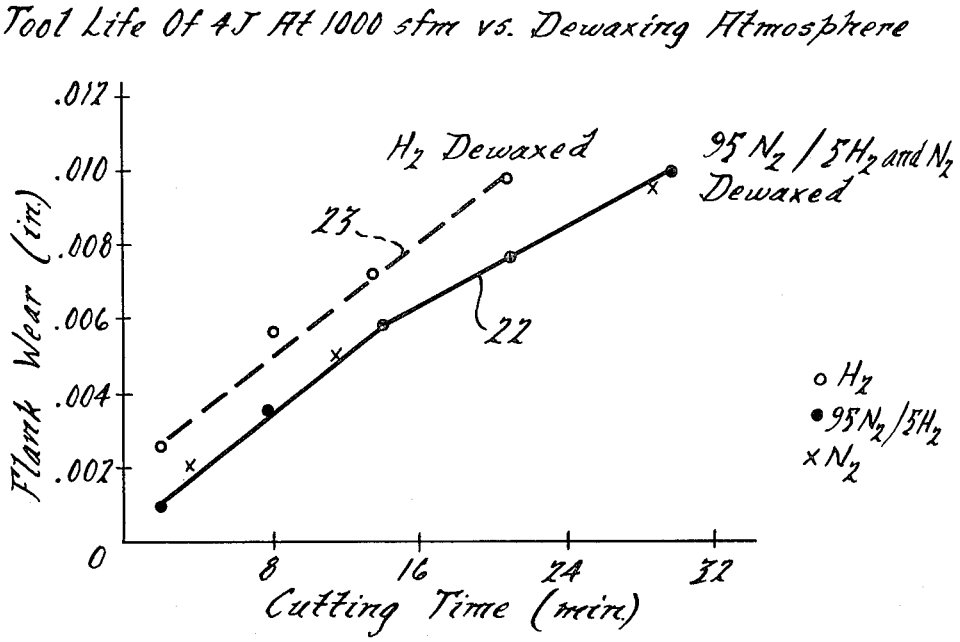
FIG. 2 is a graphical illustration similar to FIG. 1 for three finish grade cutting tools, one being subjected to the dewaxing treatment of this invention and the other not.

In FIG. 2, the relative tool life obtained for a finishing grade of TiC-Ni-MO when dewaxed under a 95 $N_2/5H_2$ atmosphere (plot 22 ), as well as pure $N_2$, is compared to a tool dewaxed under a pure hydrogen atmosphere (plot 23). The finishing grade of titanium carbide material comprises a chemistry of 12.5% Ni and 11% MO. Again, the machined stock was SAE 1045 steel, of 180 BHN, at a cutting speed of 1000 SFPM. The 95 $N_2/5H_2$ atmosphere and $N_2$ dewaxed tools had a tool life (to 0.010 inch flank wear) of 53 minutes, compared to a 41 minute life for the $H_2$ dewaxed tool.

The dewaxing atmosphere, comprised of 95% nitrogen and 5% hydrogen, affects the final carbon content of the TiC-Ni-Mo material. Since tool life is known to be related to carbon content, it was expected or anticipated that the enhanced tool life of the tools, that were subjected to a nitrogen based atmosphere during dewaxing, could be explained on the basis of carbon content alone. However, this was not found to be the case. Two tool compositions one dewaxed under 95% $N_2/5H_2$ and the other under pure $H_2$, each of which had initial carbon contents adjusted so that their final carbon values would be close to each other, rendered test data as shown in Table I. Despite the fact that their carbon contents were almost identical, the tool life of the $N_2/H_2$ dewaxed sample was 23% longer in life than the $H_2$ dewaxed one.

TABLE I

TOOL LIFE OF TiC BASE TOOLS OF SIMILAR CARBON CONTENT AND DIFFERENT DEWAXING ATMOSPHERES

| Lot # | Dewax Atm. | Initial Carbon Wt. % | Final Carbon Wt. % | Tool Life @ 600 SFPM (to .010"flank wear) |
|---|---|---|---|---|
| 102-27 | $H_2$ | 13.88 | 13.32 | 48 min. |
| 102-28N | 95% $N_2/5H_2$ | 13.57 | 13.29 | 59 min. |

I claim:

1. A method of making cemented titanium carbide based cutting tools, wherein substantially unoxidized titanium carbide, other refractory carbides of groups 4, 5 and 6 transition metals of the periodic table, and binder metal powders are mixed and ground to submicron particle size in the presence of an oxidation inhibiting liquid ingredient covering the particles of said powders, the titanium carbide constituting a major proportion of the mixture, displacing said liquid ingredient with a low-boiling pressing aid, compacting the ground powder particles under ambient conditions to form a shape having some degree of porosity to permit penetration of gases into the compact, then firstly heating the shape to volatilize the pressing agent, and then secondly heating the shape in a vacuum to a higher temperature level for effecting sintering of said shape, said first heating being carried out under a flowing nitrogen based atmosphere containing 0–10% $H_2$.

2. The method as in claim 1, in which said first heating is carried out for a period of 0.75–1.5 hours at a temperature of 570°–770° C.

3. The method as in claim 1, in which the binder metal is selected from the group comprising molybdenum, nickel and chromium and wherein at least 5% $H_2$ is mixed with said nitrogen based atmosphere to promote reduction of any oxides appearing on said binder metal powder during said first heating.

4. The method as in claim 1, in which said powders are ground to a particle size that is below one micron, and a distribution in which 0.5 micron predominates.

5. The method as in claim 1, wherein the resulting sintered product exhibits an increased tool life of at least 40%, as measured by the time of tool usage at a predetermined speed, depth of cut and feed before 0.01 inches of flank wear is experienced.

6. The method as in claim 1, in which the carbide combined with said titanium carbide is selected from the group consisting of vanadium carbide and molybdenum carbide.

7. The method as in claim 1, in which said pressing agent is selected from the group consisting of polyethylene glycol, paraffin and stearic acid.

8. The method as in claim 1, in which the low-boiling oxidation inhibiting ingredient is selected from the group consisting of benzene, pentane, acetone, hexane, naptha, and chlorinated hydrocarbons.

9. A method for improving the tool life of a finishing grade titanium carbide cutting tool, said cutting tool containing a binder constituent consisting of 10–50% of the admixture and consisting essentially of a particulate having elemental or a combined form of nickel, chromium and molybdenum, the chromium, if present, being present in an amount measured as elemental chromium in the range between 10–40% of said nickel and said molybdenum being present in an amount between 25–70% of said binder, the method comprising:

(a) mixing substantially unoxidized nickel, chromium and molybdenum laden powders with a major proportion of titanium carbide powder, (b) grinding said mixture to a predetermined submicron particle size in the presence of an oxidation inhibiting liquid which has a low-boiling point, (c) displacing the oxidation inhibiting ingredient with a low-boiling point pressing aid, and drying said ground mixture, (d) compacting under ambient conditions said ground particles and pressing said mixture to a density less than full theoretical, (e) pretreating said compacted article by heating to a temperature level of 570°–770° C. under a nitrogen based atmosphere for a period of time of at least 0.75 hours, and (f) sintering said pretreated compact in the presence of a vacuum having a pressure of approximately one micron, at a temperature level of at least 1300° C., for a period of time related to said temperature level to effect sintering.

* * * * *